US007230574B2

(12) United States Patent
Johnson

(10) Patent No.: US 7,230,574 B2
(45) **Date of Patent: *Jun. 12, 2007**

(54) ORIENTED PIFA-TYPE DEVICE AND METHOD OF USE FOR REDUCING RF INTERFERENCE

(76) Inventor: Greg Johnson, 1931 Seascape Blvd., Aptos, CA (US) 95003

( * ) Notice: Subject to any disclaimer, the term of this patent is extended or adjusted under 35 U.S.C. 154(b) by 186 days.

This patent is subject to a terminal disclaimer.

(21) Appl. No.: 10/917,945

(22) Filed: Aug. 13, 2004

(65) Prior Publication Data

US 2006/0033667 A1 Feb. 16, 2006

Related U.S. Application Data

(63) Continuation-in-part of application No. 10/262,447, filed on Sep. 30, 2002, now Pat. No. 6,639,564.

(60) Provisional application No. 60/357,162, filed on Feb. 13, 2002.

(51) Int. Cl.
*H01Q 1/24* (2006.01)

(52) U.S. Cl. ..... 343/702; 343/700 MS; 343/846

(58) Field of Classification Search ..... 343/700 MS, 343/845–849, 700, 702, 815, 817, 829
See application file for complete search history.

(56) References Cited

U.S. PATENT DOCUMENTS 5,819,162 A * 10/1998 Spann et al. ..... 455/575.5
6,009,311 A 12/1999 Killion et al.
6,084,975 A 7/2000 Perkins
6,326,921 B1 12/2001 Egorov et al.
6,342,859 B1 * 1/2002 Kurz et al. ..... 343/702
6,556,812 B1 * 4/2003 Pennanen et al. ..... 343/702
6,639,564 B2 * 10/2003 Johnson ..... 343/702
7,012,571 B1 * 3/2006 Ozkar et al. ..... 343/702
2001/0052877 A1 * 12/2001 Honda et al. ..... 343/702
2002/0070902 A1 * 6/2002 Johnson et al. ..... 343/702
2002/0149523 A1 * 10/2002 Fang et al. ..... 343/702
2003/0146876 A1 * 8/2003 Greer et al. ..... 343/702
2004/0204006 A1 * 10/2004 Zhou et al. ..... 455/550.1
2004/0235432 A1 * 11/2004 Lin et al. ..... 455/90.3
2005/0212706 A1 * 9/2005 Ying et al. ..... 343/702

OTHER PUBLICATIONS

Patent Cooperation Treaty, International Search Report, for PCT/US03/04230, dated Jul. 2, 2003.

* cited by examiner

*Primary Examiner*—Tho Phan
(74) *Attorney, Agent, or Firm*—Fulbright & Jaworski L.L.P.

(57) ABSTRACT

An oriented PIFA-type apparatus for reducing hearing aid radio frequency (RF) interference including a directional multi-band and/or single band antenna for use with PWDs such as digital cellphones is disclosed. The apparatus greatly reduces or eliminates the audio noise induced in hearing aids by the PWDs and allows operation of a hearing aid during PWD operation. In operation, the apparatus may be provided on the PWD side away from the user's head. The apparatus may be integrated into the PWB during its manufacture or provided as an after market assembly for a PWD that has a port for connection of an external antenna. The apparatus provides for improved front-to-back ratio as compared to antennas currently in use on PWD's, and therefore also reduces SAR (specific absorption rate), the level of RF energy received into the head by a PWD.

21 Claims, 14 Drawing Sheets

FIG. 14
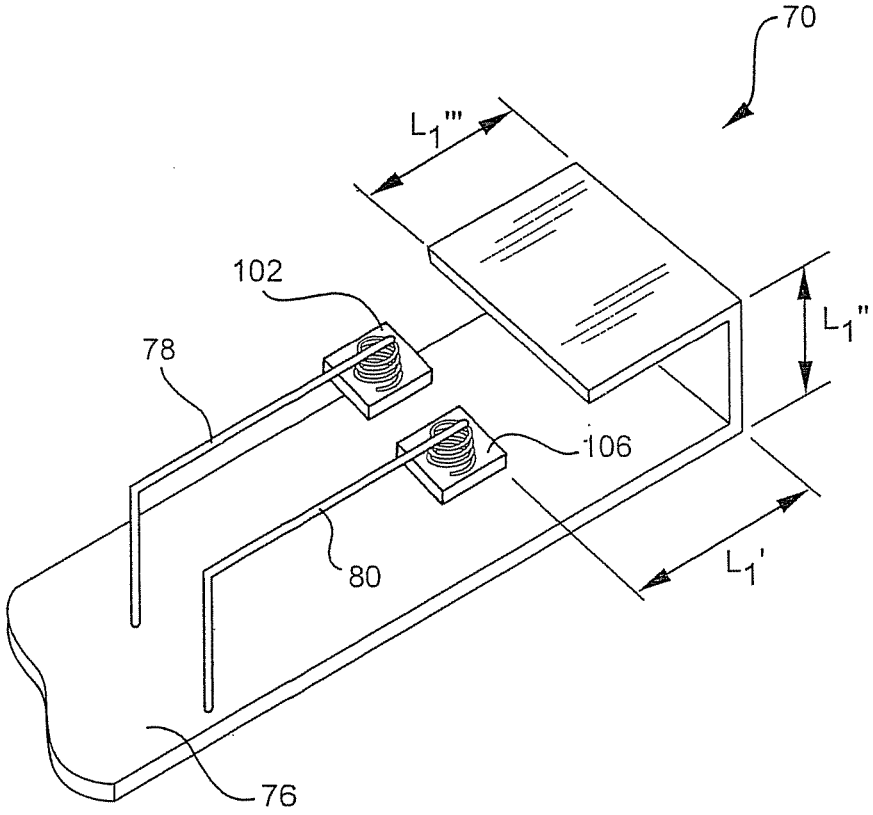
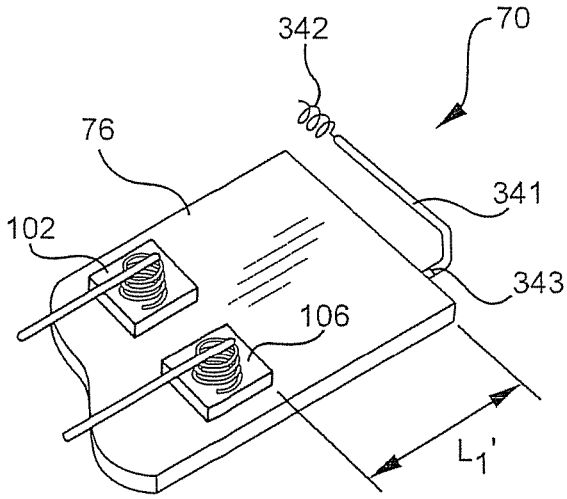
FIG. 15

ORIENTED PIFA-TYPE DEVICE AND METHOD OF USE FOR REDUCING RF INTERFERENCE

This is a continuation-in-part application of application Ser. No. 10/262,447, filed Sep. 30, 2002 now U.S. Pat. No. 6,639,564, which claims benefit of provisional Application No. 60/357,162, filed Feb. 13, 2002.

RELATED APPLICATIONS

PCT Patent Application US/03/04230, filed Feb. 12, 2003,
U.S. patent application Ser. No. 10/262,447, filed Sep. 30, 2002, and
U.S. Patent Application Ser. No. 60/357,162, filed Feb. 13, 2002.

FIELD OF THE INVENTION

The present invention relates to a portable wireless communications device. More particularly, the present invention relates to an oriented PIFA assembly and ground conductor for reducing the specific absorption rate (SAR) of the associated device during operation.

BACKGROUND

SAR (specific absorption rate) for users of portable wireless devices (PWDs) is a matter of increasing concern. RF radiation to the user's head results from the free-space generally omnidirectional radiation pattern of typical current PWD antennae. When PWDs equipped with such an antenna are placed near the user's head, the antenna radiation pattern is no longer omnidirectional as radiation in a large segment of the azimuth around the user is blocked by the absorption/reflection of the user's head and hand. An antenna system for PWDs that greatly reduces radiation to the body and redirects it in a useful direction is also desirable.

Prior art antennas for PWDs may cause audio noise in a hearing aid of the user. Referring to FIG. 16, a diagrammatic view of a prior art PWD 400 (in the form of a cellphone) used in the vicinity of a hearing aid 402 is illustrated. Cellphone 400 has a speaker on the keyboard surface near the top of the phone, which is normally aligned with the center of the user's ear 404 during use. Hearing aid 402 may be any type, including in-ear and behind-ear variations. Hearing aid 402 has an amplified audio output port 406, which is inserted into the ear canal of the ear 404. During operation, an electromagnetic field 408 is generated around cellphone 400 by omnidirectional antenna 440. In operation, electromagnetic field 408 illuminates the hearing aid 402, user's ear 404, and the user's head. RF noise is induced in the hearing aid by the field 408, resulting in excessive audio noise being presented to the user.

The planar inverted F antenna or PIFA is characterized by many distinguishing properties such as relative lightweight, ease of adaptation and integration into the device chassis, moderate range of bandwidth, omni directional radiation patterns in orthogonal principal planes for vertical polarization, versatility for optimization, and multiple potential approaches for size reduction. Its sensitivity to both vertical and horizontal polarization is of practical importance in mobile cellular/RF data communication applications because of the absence of the fixed antenna orientation as well as the multi-path propagation conditions.

To assist in the understanding of a conventional PIFA, a conventional single band PIFA assembly is illustrated in FIG. 17. FIG. 17 illustrates a prior art single-band PIFA antenna 440 located on the rear side 442 of a personal wireless device 444. PIFA 440 consists of a radiating element 446, a ground plane 448, a feed conductor 450, and a grounding conductor 452. PIFA 440 is typically positioned near an upper edge of ground plane 448 with the free end of radiating element 446 being closer to a user's hand than the feed conductor 450 and grounding conductor 452. The feed conductor 450 serves as a feed path for radio frequency (RF) power to the radiating element 446. The feed conductor 450 is electrically insulated from the ground plane 448. The grounding conductor 452 serves as a short circuit between the radiating element 446 and the ground plane 448. The resonant frequency of the PIFA 440 is determined by the length (L) and width (W) of the radiating element 446 and is slightly affected by the locations of the feed conductor 450 and the grounding conductor 452. The impedance match of the PIFA 440 is achieved by adjusting the dimensions of the conductors 450, 452, and by adjusting the separation distance between the conductors 450, 452. In operation, ground plane 448 radiates RF energy which is absorbed by a user's hand. Antenna 440 can be configured to reduce the SAR value to 1.6 mw/g with the PWD 444 transmitting at the 0.5 watt cw level. However, even at this level audio noise may be generated in a user's hearing aid by operation of PWD 444. Another limitation of the PIFA is its relatively low front-to-back ratio. Front-to-back ratios of typically PIFAs range from 0 to 2 dB. A 5 dB front-to-back ratio may be achieved by substantially increasing the distance between radiating element 446 and ground plane 448. A need exists for an antenna exhibiting substantially greater front-to-back ratios.

FIG. 18 illustrates a prior art dual-band PIFA antenna 462, which is located on the rear of a personal wireless device 464, and electrically connected to ground plane 466 at one end and capacitively coupled to ground plane 466 at another end. PWD 464 further includes a battery pack 470 positioned away from antenna 462. In normal operation, PWD 464 is oriented in an upright manner so that end 472 is generally above end 474. Ground plane 466 is provided by the ground traces of the printed wiring board (PWB). The portion of antenna 462 indicated by numeral 476 resonates over a higher frequency band, while the entire portion 476, 478 of antenna 462 resonates over a lower frequency band. PIFA antenna 462 is grounded at its upper end at location indicated as numeral 480 to ground plane 466. PIFA antenna 462 is capacitively coupled at pad 482 in a direction away from upper end 472 of PWD. This type of antenna provides some reduction in SAR, but has limited ability to reduce hearing aid noise from a digital PWD.

Despite all of the desirable properties of a PIFA, the PIFA has the limitation of a rather large physical size for practical application. A conventional PIFA should have the semi-perimeter (sum of the length and the width) of its radiating element equal to one-quarter of a wavelength at the desired frequency. With the rapidly advancing size miniaturization of the radio communication devices, the space requirement of a conventional PIFA is a severe limitation for its practical utility.

SUMMARY OF THE INVENTION

The device of the present invention greatly reduces radiation directed toward a user's hand and head during device operation. As a result, the device promotes a reduction of the SAR for a PWD. Other benefits include longer transmit/ receive range, lower transmit power, and longer battery life. Yet another benefit is the reduction in PWD generated noise in a user's hearing aid.

A device according to the present invention may include a PWD implemented for operation over single or multiple frequency-band. An antenna may be incorporated within a PWD at the time of manufacture, or may be provided as an accessory or after market item to be added to existing PWDs having an external antenna port. The latter feature is particularly useful, in that existing PWDs can be retrofitted to achieve the benefits of the antenna of the present invention, including elimination of hearing aid noise and very low SAR. The antenna of the present invention is suitable for high-volume, low cost manufacturing. The antenna/PWD combination, whether an aftermarket or original equipment item, may be placed in a leather or plastic case, such that the antenna side of the PWD is facing away from the body. This provides a further advantage with respect to SAR, when the PWD is stored via a belt clip when in receive-only mode.

Other objects of the present invention include:

the provision of an antenna exhibiting high gain and a front-to-back ratio which is substantially greater than known antenna devices;

the elimination (or substantial reduction) of audio noise in hearing aids caused by close proximity to transmitting PWDs, particularly PWDs operating in one or more frequency bands, enabling use of hearing aids in close proximity to such PWDs;

the reduction in SAR due to operation of a single or multi-band PWD near the user's head;

the provision of an antenna suitable for integration within or upon a PWD;

the provision of an antenna having wide bandwidth in one or more frequency bands;

the provision of an antenna having one or more active elements and one or more passive elements, each resonant on one or more frequency bands;

the provision of an antenna which radiates RF energy from a PWD preferentially away from a user thereof;

the provision of an antenna promoting increased PWD battery life by reducing commanded RF power;

the provision of an antenna having a reduction in the amount of RF energy being absorbed by a user's hand and head during operation; and the provision of an antenna with the one or more active element(s) connected to a PWDs transmit/receive port.

These and further objects of the present invention will become apparent to those skilled in the art with reference to the accompanying drawings and detailed description of preferred embodiments, wherein like numerals refer to like parts throughout.

BRIEF DESCRIPTION OF THE DRAWINGS

FIG. 14 is yet another embodiment of an antenna according to the present invention.

FIG. 15 is yet another embodiment of an antenna according to the present invention.

DETAILED DESCRIPTION OF THE INVENTION

Figure 1:
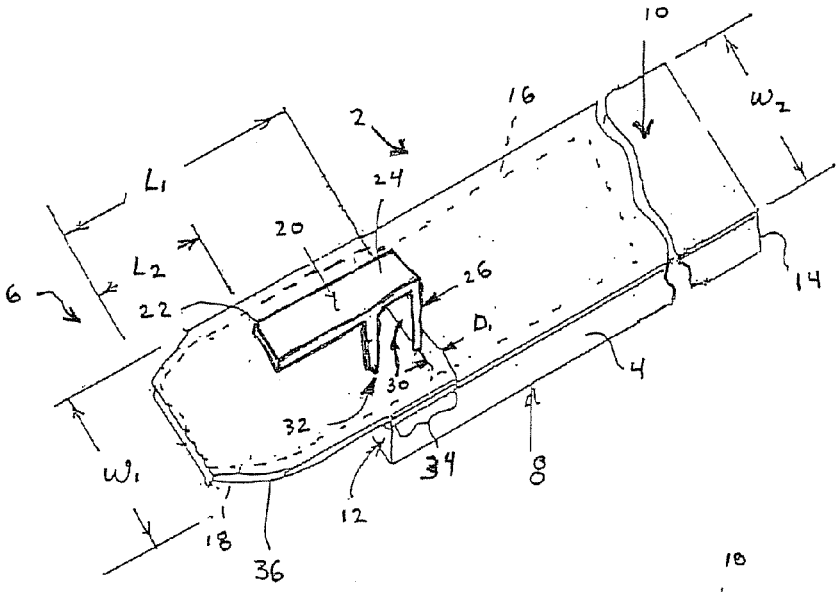
FIG. 1 is a perspective view of a first embodiment of a device according to the present invention.
Figure 2:
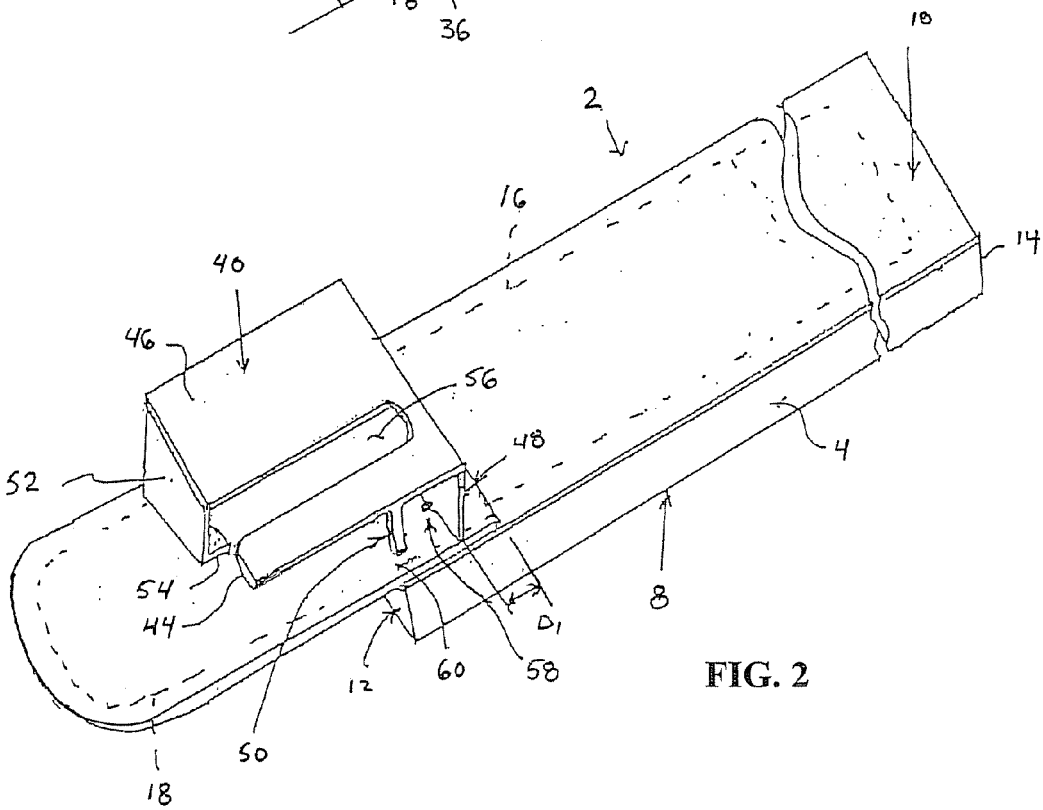
FIG. 2 is a perspective view of a second dual band embodiment of a device according to the present invention.
Figure 3:
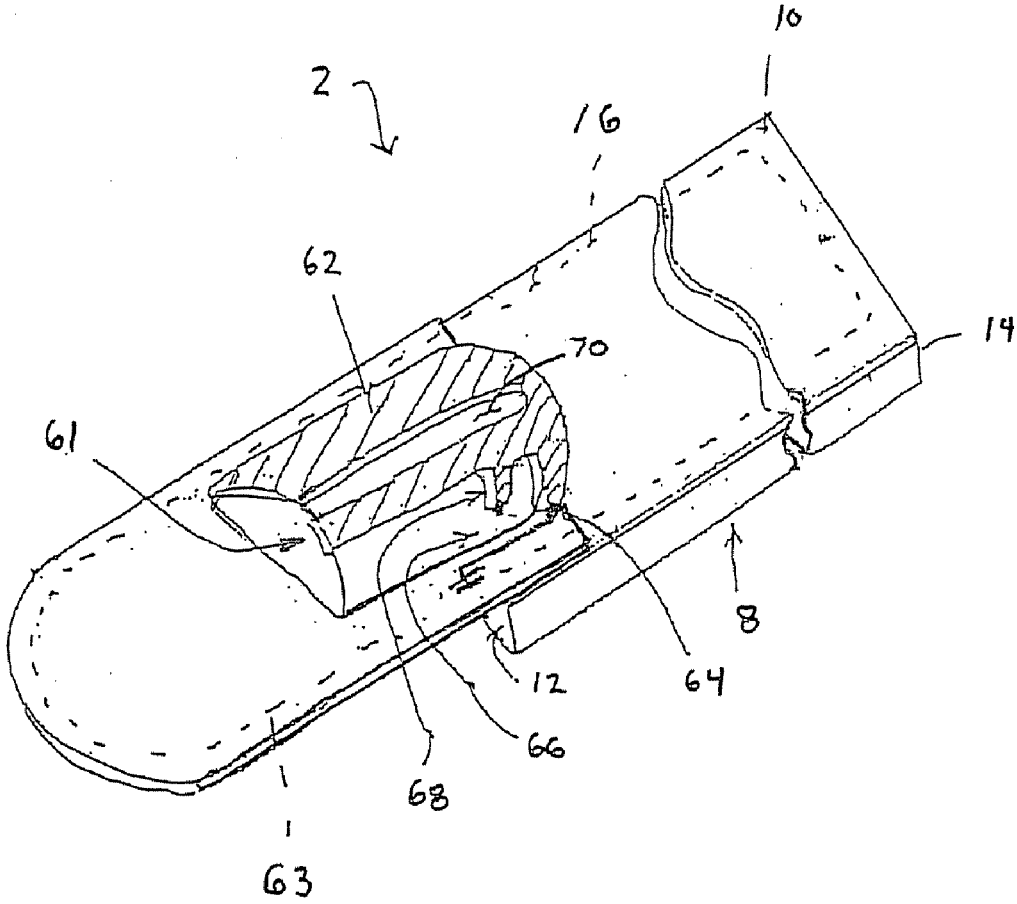
FIG. 3 is a perspective view of a third embodiment of a device according to the present invention.

Referring to FIGS. 1 through 3, a device according to one embodiment of the present invention is indicated as numeral 2. Device 2 includes a portable wireless device "PWD" 4 and a PIFA antenna structure 6. Relative to a user, in operation PWD 4 includes a front side 8 which is nearer to the user than a back side 10. PWD 4 has a top 12 and a bottom 14. In operation, bottom 14 is between top 12 and the ground surface upon which the user is positioned. PWD 4 is generally aligned in operation so that its top 12 is above a user's hand which grasps the PWD. PWD 4 includes a ground plane 16, typically a conductive plane within a printed wiring board upon which electronic components are secured.

Antenna structure 6 includes a ground plane conductor element 18 and a configured conductive radiating element 20. Element 20 may include a plurality of planar surfaces or may be configured to have some curvature or other shape. Element 20 may be formed as a metal part or may be a plating or conductive layer disposed upon a support element.

FIG. 1 illustrates a single-band version of a device according to the present invention. Element 20 is an upwardly directed conductor having a free end 22 of conductor 24, a leg conductor 26, and a leg conductor 28. Leg conductor 26 is connected to ground plane 18 at an opposite end as indicated by numeral 30 on leg 26. A feedpoint 32, having a desired impedance, is defined upon leg conductor 28. Conductors 24, 26, 28 may be provided with differing widths and/or thicknesses. A coax line or a microstrip or other type of transmission line may be used to couple the feedpoint to signal electronics of PWD 4. In operation, free end 22 is above leg elements 26, 28 relative to the ground surface upon which the user is positioned.

Figure 17:
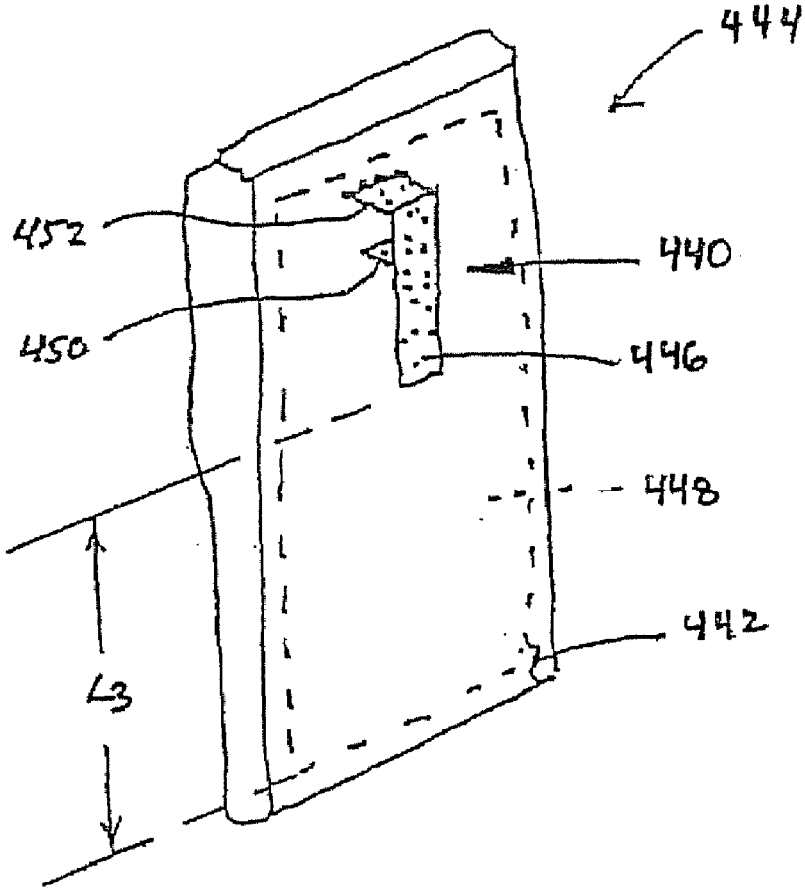
FIG. 17 is a perspective view of a prior art device.
Figure 18:
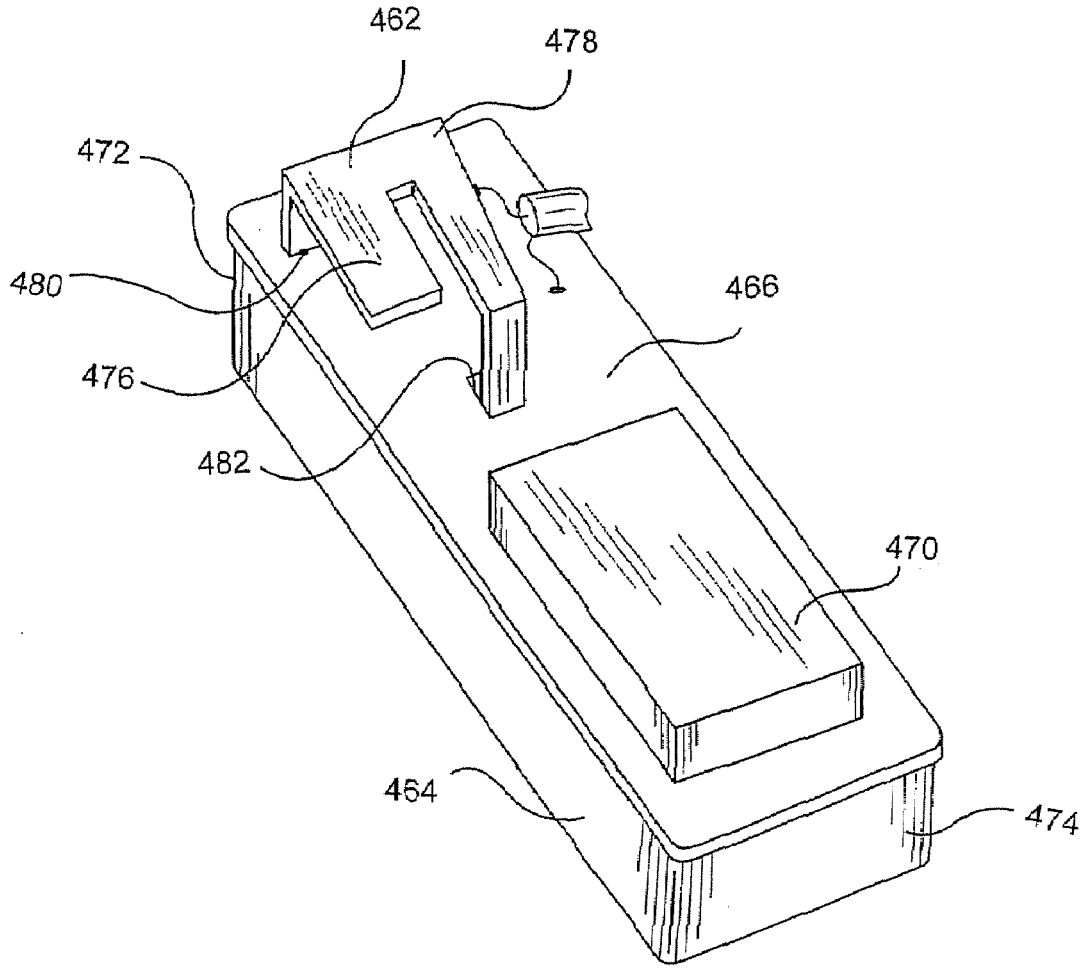
FIG. 18 is a perspective view of another prior art device.

In the illustrated embodiment, ground plane element 18 is a separate conductor from ground plane 16 of PWD 4. Element 18 may optionally be electrically connected to ground plane 16. A portion 34 of element 18 overlaps a portion of ground plane 16 of PWD 4. Element 18 is illustrated with a tapered end 36. In alternative embodiments, element 18 may assume various other shapes. Element 18 may have holes, slots or other openings (not shown). Element 18 may be curved or configured to reduce its overall length, i.e., element 18 need not be a planar element. For example, the free end of element 18 may be bent toward or away from front side 8 of PWD 4. Element 18 may be provided within an accessory item for a PWD 4. Alternatively, element 18, may be incorporated within the overall housing of a PWD 4. Element 18 may be extendible relative to PWD 4. The width "W1" of element 18 is preferably equal to the width "W2" of PWD ground plane 16. A distance "D1" between the grounding conductor 26 and the edge of ground conductor 18 is between $\frac{1}{8}^{th}$ to 1 inch. A particular preferred D1 distance is approximately ¼ inch. The overall length "L1" of ground conductor 18 is between 1.5 to 3 inches. Ground plane element 18 preferably has an electrical length in the range of 0.25 to 0.6 wavelength for a frequency within the band of operation. A particular preferred L1 distance is approximately 0.4 wavelength. The length "L2" represents the portion of ground plane 18 away from conductors 24, 26, 28. In comparison to prior art PIFA devices, L2 is substantially greater than L3 of FIG. 17. As a result, L1 is substantially smaller than typical ground plane lengths of prior art functional PIFA antennas. L1 is approximately 50% shorter than typical lengths of ground planes associated with prior art PIFA antennas.

In operation, element 18 may be selectively extendible away from the body of PWD 4. A sliding coupling between element 18 and PWD 4 is envisioned, though alternative couplings would be appreciated by those of ordinary skill in the art, e.g., element 18 may be pivotally connected to PWD and rotate into position during operation. Element 18 may manually or automatically transition between an operational position (as shown in FIG. 1) and a non-operational position (not shown). Element 18 may be automatically extended into its operational position upon receipt of an RF signal. A PWD 4 according to the present invention displays a substantially higher gain and front-to-back ratio as compared to known PIFA devices. A front-to-back ratio of 30 dB may be achieved by the present invention. In comparison, known PIFA devices exhibit 0 to 2 db front-to-back ratio.

FIG. 2 is a dual band version of an embodiment of the present invention. In the drawings, like numbers reference like elements. Element 40 includes a conductor 42 having a free end 44, conductor 46, leg conductor 48, a leg conductor 50, a leg conductor 52, and a foot conductor 54. Element 40 includes a slot 56. Leg conductor 48 is connected to ground plane 18 as indicated by numeral 58. Foot conductor 54 is not conductively coupled to ground plane 18. A feedpoint 60, having a desired impedance, is defined upon leg conductor 50. Conductors 42, 46, 48, 50, 52, 54 may be provided with differing widths and/or thicknesses. A coax line or a microstrip or other type of transmission line may be used to couple the feedpoint 60 to signal electronics of PWD 4. In operation, free end 44 is above leg elements 48, 50 relative to the ground surface upon which the user is positioned. Slot 56 may assume various shapes or configurations, e.g., serpentine, curved, etc. Leg elements 52 and foot element 54 are optional.

FIG. 3 illustrates another dual band embodiment of the present invention. A dielectric element 61 is positioned between PIFA conductor 62 and ground plane 63. Ground plane 63 is movable relative to ground plane 16 including ground traces of the printed wiring board of the PWD. Ground plane 63 of FIG. 3 may be disposed upon a printed circuit board—type dielectric material by known circuit printing technology. Alternatively, ground plane 63 may be a conductive sheet attached to a support structure. Dielectric 61 may be solid or hollow. PIFA conductor 62 may be a plated surface of dielectric 61, or may be a separate formed metal element positioned relative to dielectric 61. PIFA conductor 62 is conductively coupled to ground plane 63 at location 64. A feedpoint 66 is defined upon a leg conductor 68. A slot 70 is defined on conductor 62.

Figure 4:
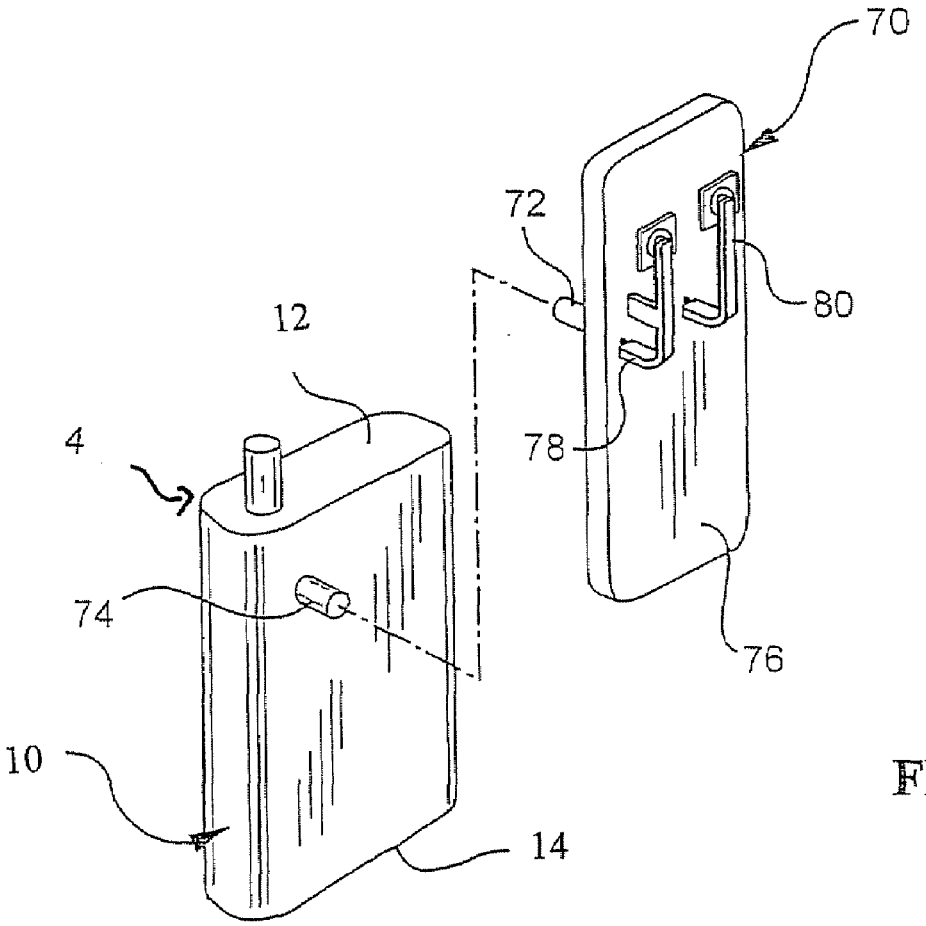
FIG. 4 is a perspective view of another embodiment of a device according to the present invention.
Figure 5:
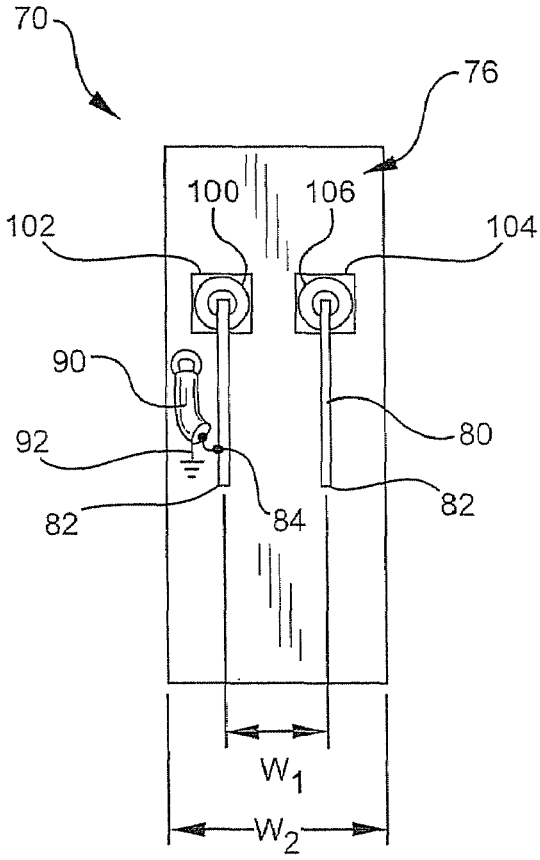
FIG. 5 is a top plan view of the device embodiment of FIG. 4.
Figure 6:
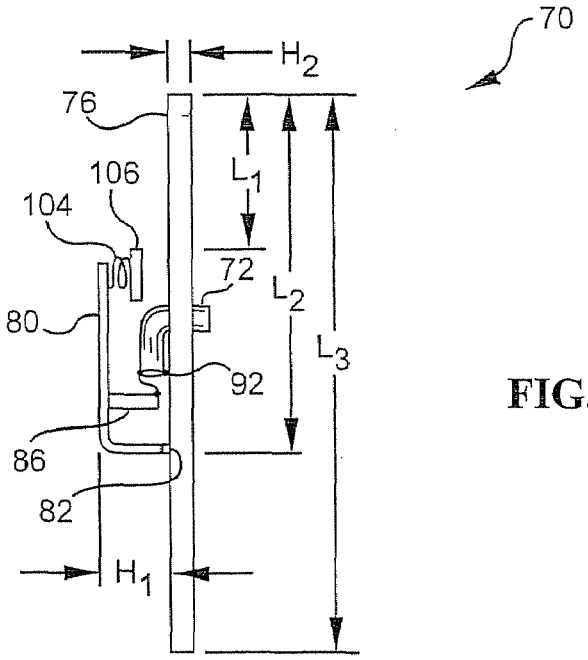
FIG. 6 is a side view of the device embodiment of FIGS. 4 and 5.

Referring to FIGS. 4 through 6, an antenna device according to one embodiment of the present invention is indicated as numeral 70. Device 70 comprises an external assembly which may be provided as an aftermarket device to improve PWD 4 performance. Device 70 has an RF port 72 which connects into an external antenna port 74 of the PWD 4. In alternative embodiments, device 70 may be connected via a coaxial cable or other type of transmission line.

Device 70 includes a conductor element 76 and a pair of configured conductive radiating elements 78, 80. Element 76 may be a planar conductive element, or may be configured to have some curvature or other shape. Element 76 preferably has an electrical length in the range of 0.3 to 0.8 wavelength for a frequency within the band of operation. Element 76 may be formed as a metal part or may be a plating or conductive layer disposed upon a support element, such as a housing, etc. Further, at least a portion of element 76 may be provided by the ground traces of the printed wiring board of a PWD within or upon which antenna 70 is located.

Each of the conductors 78, 80 has a free end and is conductively connected to element 76 at an opposite end as indicated by numeral 82 in FIGS. 5 and 6. A feedpoint 84, having a desired impedance, is defined along conductor 78. A short conductor 86 is attached at feedpoint 84. Conductor 86 is connected to the center conductor of a coaxial line 90. An outer shield of line 90 connects to conductor element 76 at location 92. In alternative embodiments, coax line 90 may be replaced by a microstrip or other type of transmission line.

In the embodiment of FIGS. 4–6, transmission line 90 connects to RF connector 72, which is selected to match the connector used for the external antenna port 74 on WCD 4. Although connector 72 is shown exiting the back side of element 76, it may take any other route as required to plug into the WCD's external antenna port. Antenna device 70 may also be incorporated into a WCD at the time of manufacture, in which case transmission line 90 would directly connect to the RF input/output point of the WCD's transceiver.

Elements 78, 80 are designed to resonant over one or more frequency bands. As an example, conductor 78, which is a fed element, may be resonant at a higher frequency band, with inductor 100 and conductor 102 acting as a "trap" or electrical stop for said higher frequency band. The term "LC trap" as used herein is defined to mean either a inductor/capacitance trap or an inductive trap. Coil 100 and conductor 16 may be selected so as to cause the combination of elements 78, 100, and 102 to resonate at a lower frequency band, thus providing a dual-band element having one feedpoint.

Element 80, which is not directly connected to feedline 90, may have its length adjusted to resonate over the same or nearly the same frequency bands as 78. Inductor 104 and conductor 106 may be selected to act as a "trap" or stop for the said higher frequency band, and the combination of elements 80, 104, and 106 may be selected to resonate at a lower frequency band, which may be the same or nearly the same as that of elements 78, 100, and 102. Again, a greater bandwidth in a lower frequency band is attained with two adjacent elements (78, 100, 102) and (00, 104, 106) than with a single element. The higher frequency band may be 1850–1990 MHz, and the lower frequency band may be 824–894 MHz. A range and preferred values of dimensions for these frequency bands are as follows;

| Dimension | Range | Preferred Dimension |
|---|---|---|
| W1 | 0.25–1.525 in. | 0.75 in. |
| W2 | 1–6 in. | 1.6 in. |
| H1 | 0.3–2 in. | 0.75 in. |
| H2 | 0.001–0.5 in. | 0.02 in. |
| L1 | 1.5–4 in. | 2.75 in. |
| L2 | 0.5–4 in. | 1 in. |
| L3 | 4–8 in. | 5.25 in. |

Conductors 78, 80 may have any cross section, including round and rectangular. One preferred cross section is 0.05 in diameter round wire.

Conductor 76 length, L3, is greater than the length of elements 78 and 80. Conductor 76 may be defined by a plurality of conductive trace elements on a dielectric board, such as a printed wiring board. Through additional experimentation by those skilled in the relevant arts, the traces may assume a variety of configurations.

Element 78 and 80 are oriented upon conductor 76 so that the free ends of the elements 78, 80 are above the connection ends 82 during device operation. In other words, during device operation, elements 78, 80 are upwardly directed. In a typical operation of PWD 4, elements 78, 80 would be more or less perpendicular to the floor or ground surface upon which the operator is positioned. For an embodiment of antenna 70 which is integrated within a PWD 4, elements 78, 80 are secured at first ends to conductor 76 and have free ends extending in a direction toward the top 12 of PWD 4.

Figure 7:
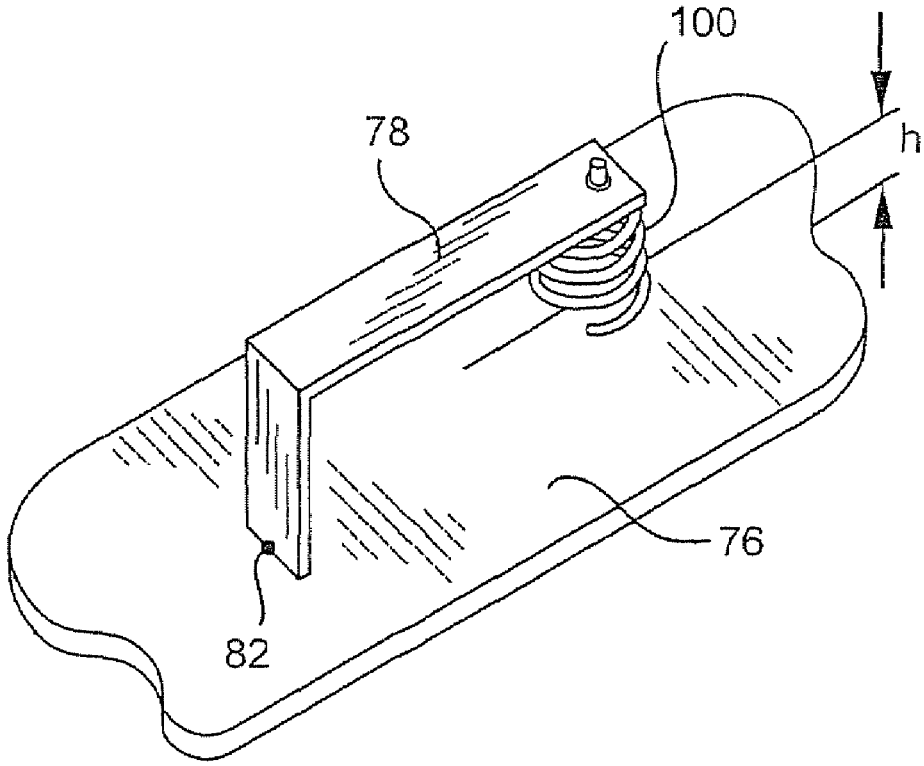
FIG. 7 is a perspective partial view of another embodiment of the present invention.

FIG. 7 shows another embodiment of the element 78 and trap inductor 100. Inductor 100 is a wire element having windings which may be uniformly spaced or which may be non-uniformly spaced. In this particular embodiment, inductor windings 100 are more closely spaced proximate to element 78 than proximate to the conductor element 76, i.e., the "pitch" of the wire winding varies across its length. The resonant frequency of the combination 78 and 100 may be adjusted by varying height "h".

Figure 8:
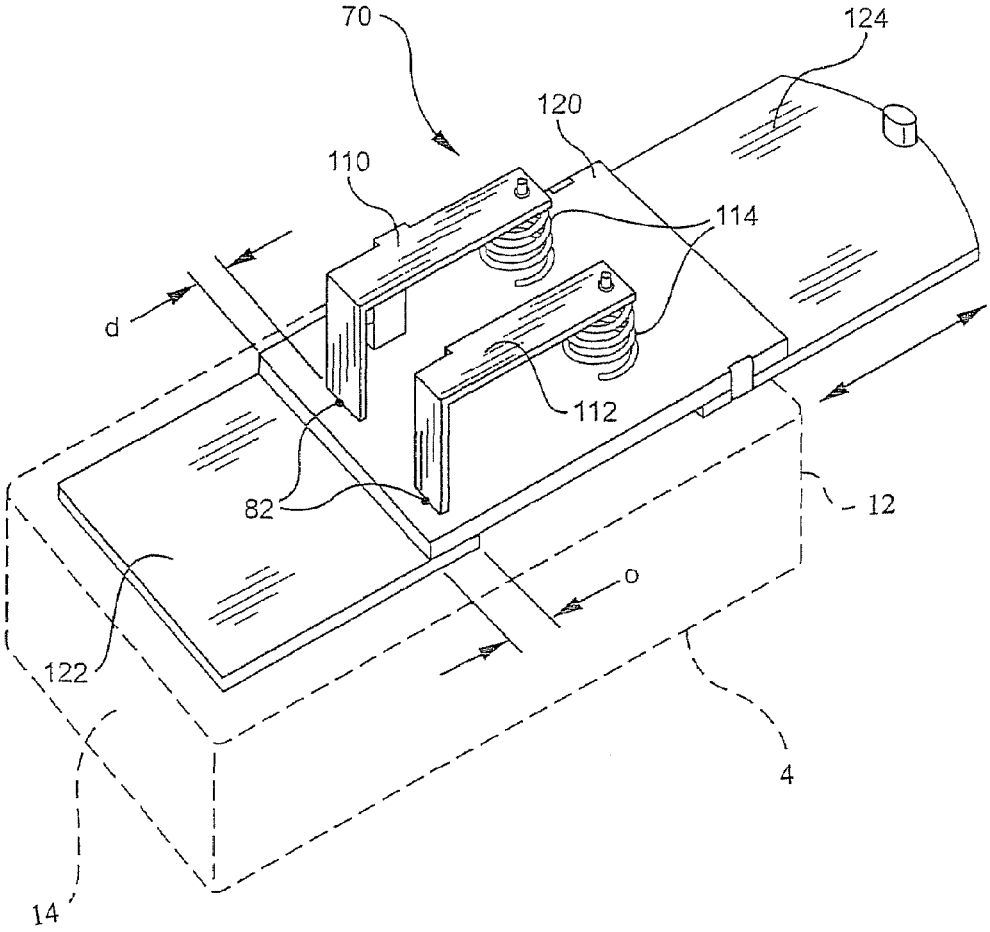
FIG. 8 is a perspective view of yet another embodiment of a device according to the present invention.

FIG. 8 illustrates features of another embodiment of an antenna device 70 according to the present invention. Radiating elements 110, 112 are coupled at a position relative far away from the top 38 of the PWD 4, and the open ends 114 of elements 110, 112 are in a direction toward the top of the PWD 4, e.g. during normal operation open ends 114 of elements 110, 112 are upwardly directed (e.g., away from a floor surface).

The ground plane required for the antenna system 70 may be provided separately from that within the PWD 4, by conductive segments 120, 122 and 124. Segments 120, 122 may be capacitively coupled within the overlap region "O". Segments 124, 120 are electronically connected, and segment 124 may slide in and out relative to 120 to reduce size, when the PWD 4 is not in use. Segment 124 may be manually retracted as during PWD 4 operation. In alternative embodiments, segment 124 may be automatically extended during operation, such as via a small solenoid, motor and gearing, etc.

Figure 9:
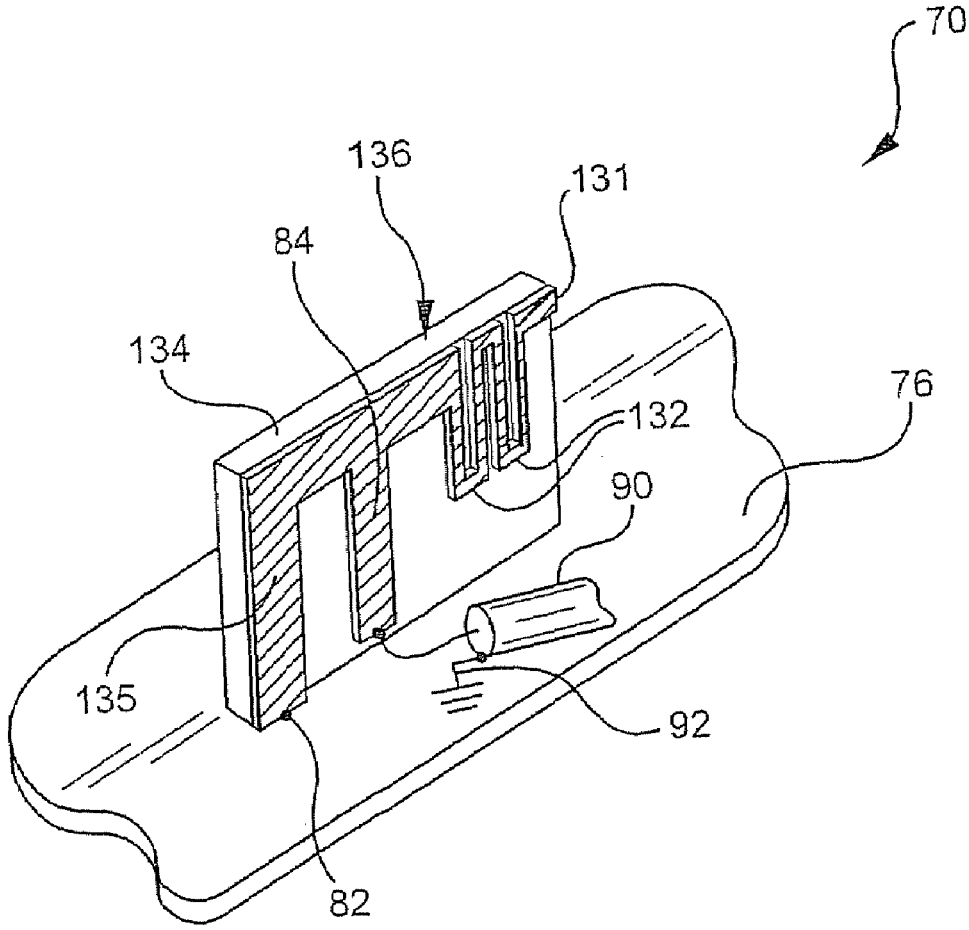
FIG. 9 is a perspective partial view of another embodiment of the present invention.

Referring to FIG. 9, an alternative embodiment of a driven element 136 of the antenna 70 of the present invention is shown. In this embodiment, PWB (printed wiring board) technology is utilized to facilitate close dimensional tolerances for the antenna. A dielectric printed wiring board 134, which may have a dielectric constant in the range 2–30, is used to support the element conductors 131, 132, 135. The feed point is indicated as numeral 84. Connection point to coax line 90 is indicated as numeral 133. Meander line inductor 132 corresponds to inductor 100 from FIGS. 4–6. Although meander line inductor 132 is shown as a meander line on one surface of the PWB 134, one skilled in the art would recognize that it could also be implemented as traces occupying both sides of PWB 134, with plated-through holes ("vias") connected the line segments. Although the driven elements 131, 132, 135 alone are depicted in FIG. 9, the same construction may be used to fabricate the non-driven element as well.

Figure 10:
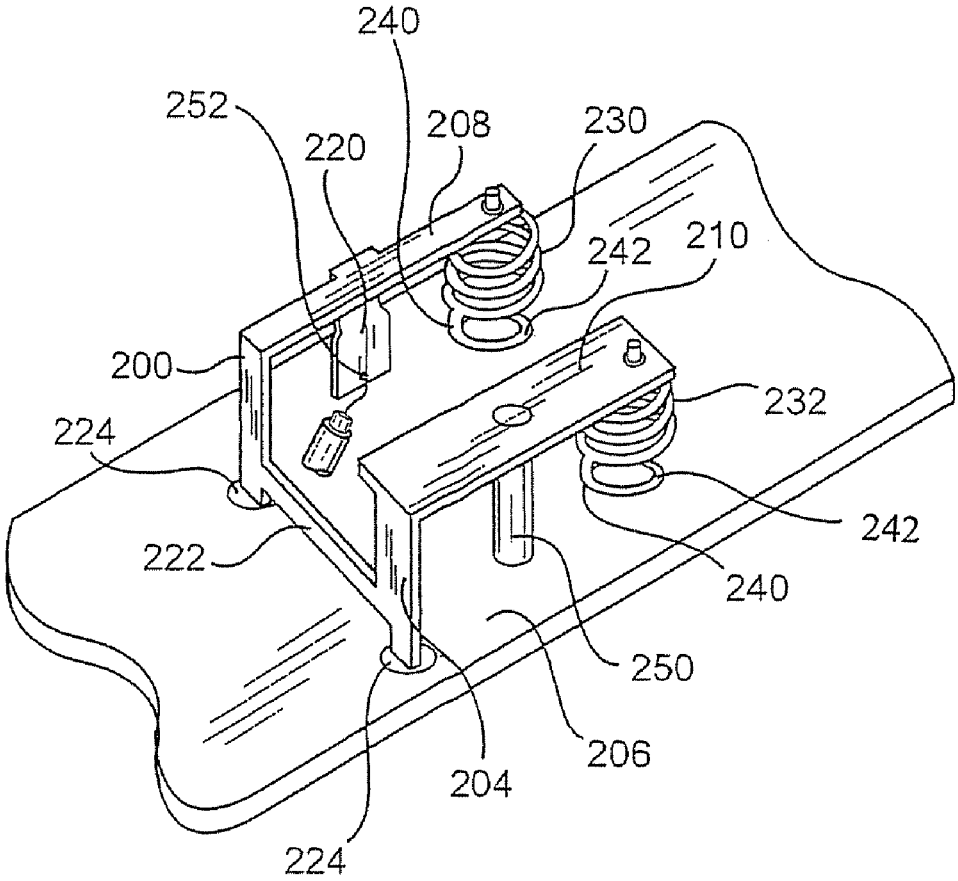
FIG. 10 is a perspective view of yet another embodiment of a device according to the present invention.

Referring to FIG. 10, another embodiment of the antenna 70 of the present invention is shown in perspective view. The various conductive elements consisting of leg elements 200 and 204 (which are generally perpendicular relative to conductive element 206), elements 208 and 210 (which are generally parallel to conductive element 206), feed conductor 220, and crossbar conductor 222 all of which may be formed as a single stamped metal part. The bottom ends of legs 200, 202 are inserted into slots 224 in element 206, and may be soldered or otherwise captured mechanically.

Element leg 204 and element 210 may preferably be wider than corresponding leg element 200 and element 208. Inductors 230, 232 may have extensions 240 leading to an additional turn or turns 242, 244. This construction of the inductor 230, 232 eliminates a separate conductor plate 102, 106 at the end of the coils, 100, 104 as shown in FIG. 5.

Elements 28 and/or 210 may be supported by dielectric post 250 and a dielectric clamp (not shown) at location 252, respectively.

Figure 11:
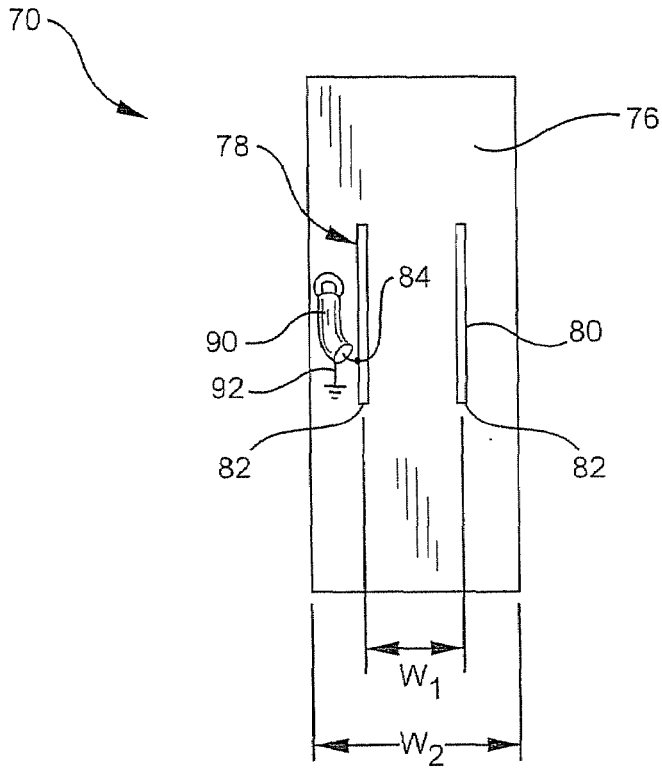
FIG. 11 is a top plan view of the device embodiment of a single-band embodiment of the present invention.
Figure 12:
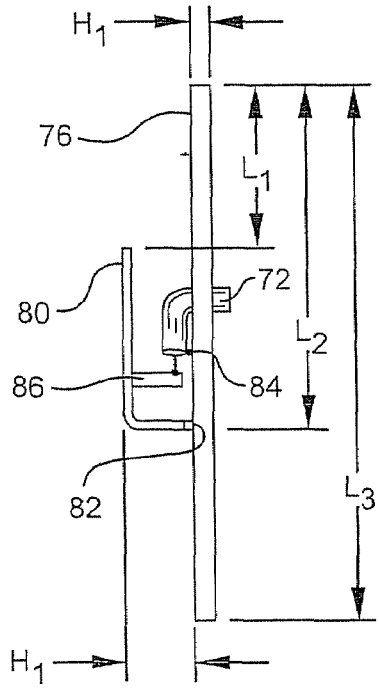
FIG. 12 is a side view of the device embodiment of FIG. 11.

Referring to FIGS. 11 and 12, yet another embodiment of a device according to the present invention is illustrated. Antenna 70 in this embodiment is a single band antenna assembly. In comparison to the dual-band embodiment of FIGS. 4–6, this embodiment of antenna 70 does not require the trap tuning elements, e.g., elements 100, 102, 104, and 106 of FIGS. 5 and 6.

Figure 13:
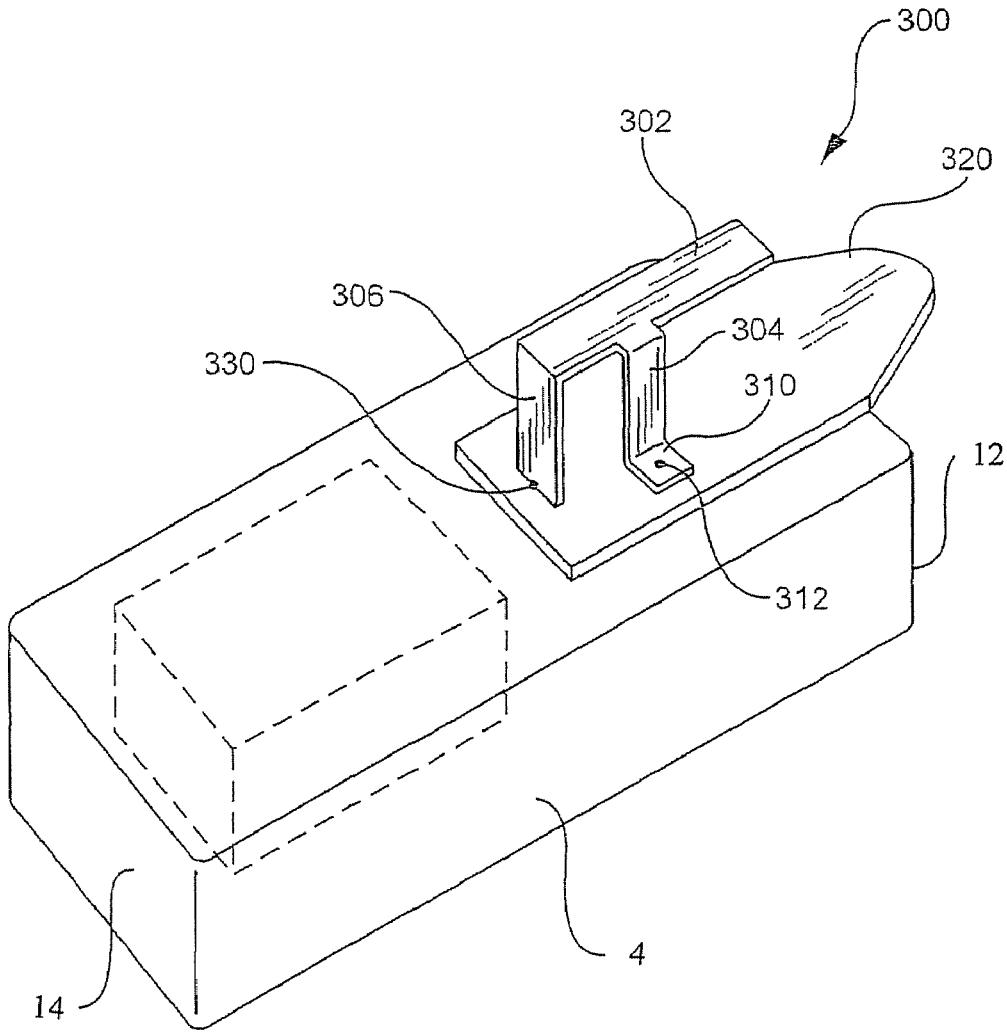
FIG. 13 is yet another embodiment of an antenna according to the present invention.
Figure 16:
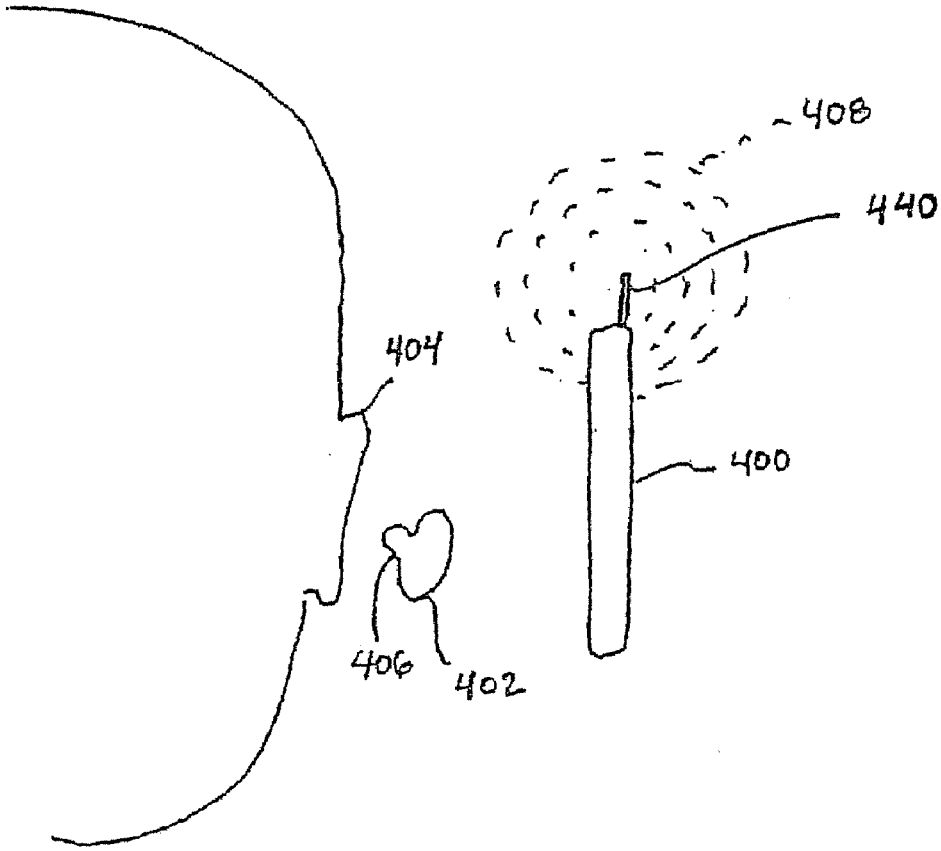
FIG. 16 is a diagrammatic view of a prior art device in operation.

FIG. 13 shows a single band embodiment of the antenna 300 of the present invention. Antenna 300 is located near the top 38 of PWD 4. The radiating element has three segments 302, 304, 306. A microstrip feed section 310 is shown connected to the rf input/output port of the PWD at 312. A ground plane 320, separate from the internal ground plane of PWD 4, is used. Segment 306 is electrically connected to 320 at location 330. Ground plane 320 may extend beyond the top of PWD 4, and it may be a sliding type as shown in FIG. 8. Ground plane 320 may be provided, at least in part, by the ground traces of the printed wiring board of PWD 4, particularly in an application where antenna 300 is integrated within the PWD 4.

Antenna 300 may function as a single band antenna suitable for operation over the range of 1710–1990 MHz, for example. In one embodiment the dimensions: for ground plane 320 are 1.41 in. by 2.72 in; for segment 306 are 0.57 in. (width) by 0.5 in. (height); and for segment 302 are 0.57 in (width) by 1.46 in. (length). Thickness of all conductors may be in the range of 0.001–0.10 inch, with 0.020 being a preferred thickness. The length of ground plane 320 extending beyond end 38 may be in the range of 0 to 1 inch, with 0.7 in being a preferred dimension. In an embodiment of antenna 300 being incorporated within a PWD 4, ground plane 320 may not extend outside of the PWD 4 housing.

Referring to FIG. 14, another antenna embodiment 70 with a configured ground plane conductor 76 is shown. The length L1 of conductor 76 of FIG. 6 is replaced by the combination of L1', L1" and L1'". Generally, this combination of segments will have a length equal to or somewhat longer than L1 of FIG. 6, depending on the ratio of L1" to L1'". The function of this feature is to reduce the overall length of conductor 76 from FIG. 6.

Referring to FIG. 15, yet another antenna embodiment 70 with a differently configured ground plane conductor 76 is shown. Here conductor 341 and inductor 342 are closely spaced from element 76 and electrically connected to element 76 at location 343. Again, the purpose of this embodiment is to reduce the length of 76.

The above described embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A portable wireless device comprising:

a wireless communications device having a segmented ground plane element including at a plurality of ground plane segments, at least one of said plurality of segments being movable relative to the other ones of said plurality of segments during operation of the wireless device;

a driven conductor element being coupled to the segmented ground plane element, said driven conductor including a first element being generally perpendicular to the segmented ground plane element and a second element being generally parallel to the segmented ground element, said second element extending away from the wireless device; and a parasitic conductor element coupled to the segmented ground element, said parasitic conductor including a first element being generally perpendicular to the segmented ground element and a second element being generally parallel to the segmented ground element, said second element extending away from the wireless device.

2. A portable wireless device comprising:

a dual-band wireless communications device having a ground plane and associated signal generating components;

a movable antenna ground plane element being selectively movable relative to the ground plane;

a dual-band PIFA-type antenna having a pair of elongated conductors and three leg elements, one of the leg elements being conductively connected to the movable antenna ground plane element, another of the leg element defining a feed point conductively connected to the signal generating components, and the third leg element being capacitively coupled to the movable antenna ground plane element, one of the elongated conductors having a free end, and during operation said movable antenna ground plane element is extended away from the wireless communications device and said free end is away from an edge of the wireless communications device.

3. The portable wireless device of claim 2 wherein the antenna ground plane element is substantially planar.

4. The portable wireless device of claim 2 wherein the pair of elongated conductors and at least one of the three leg elements are substantially planar.

5. The portable wireless device of claim 2 wherein during operation a portion of the antenna ground plane element overlaps a portion of the ground plane.

6. The portable wireless device of claim 2 wherein prior to operation the antenna ground plane element is selectively moved in a linear direction relative to the ground plane.

7. The portable wireless device of claim 2 wherein the pair of elongated conductors are curved.

8. The portable wireless device of claim 2 further comprising:

a dielectric element disposed between the pair of elongated conductor elements and the antenna ground plane element.

9. The portable wireless device of claim 8 wherein the dielectric element defines a curved face and the pair of elongated conductors are curved with relation to the curved face.

10. A method of reducing induced RF noise in a hearing aid when used in close proximity to a wireless device, said wireless device having a top and a bottom when in operation, said method comprising the steps of:

providing a movable antenna ground plane element and a conductive element coupled to a ground plane of the wireless device;

providing first and second elongated conductor elements upon the conductive element, said first and second elongated conductor elements each having a first end connected to the conductive element and a second end, said elongated conductor elements being generally directed away from an edge of the wireless device;

coupling the first elongated conductor element to an RF signal line of the wireless device;

moving said antenna ground plane element away from the ground plane, with at least a portion of said antenna ground plane overlapping a portion of the ground plane; and parasitically coupling the second elongated conductor element to the first elongated conductor element during use.

11. The method of claim 10 further comprising the steps of:

coupling LC traps structures at the second ends of the first and second elongated conductor elements.

12. An antenna device for a wireless device comprising:

a ground plane element including at a plurality of ground plane segments, at least one of said plurality of segments being movable relative to the other ones of said plurality of segments during operation of the wireless device, said ground plane element including a conductive element having a length of at least 0.35 times an operational wavelength, said conductive element having an upper edge and a lower edge defined between a middle portion;

a driven conductor element being coupled to the conductive element within the middle portion, said driven conductor including a first element being generally perpendicular to the conductive element and a second element being generally parallel to the conductive element, said second element extending away from the wireless device; and a parasitic conductor element coupled to the conductive element at the middle portion, said parasitic conductor including a first element being generally perpendicular to the conductive element and a second element being generally parallel to the conductive element, said second element extending away from the wireless device.

13. An antenna device of claim 12 wherein the conductive element is defined as ground traces upon a printed wiring board of the wireless device.

14. An antenna device of claim 12 wherein the conductive element is substantially planar.

15. An antenna device of claim 12 wherein the second elements of the driven conductor element and parasitic conductor element are substantially parallel.

16. An antenna device of claim 12 wherein the first elements of the driven conductor element and the parasitic conductor element are connected together.

17. An antenna device of claim 12 further comprising one or more LC trap structures for effecting a dual-band operability, said LC trap structures being coupled at a free end of either the driven conductor element or the parasitic conductor element or both.

18. An antenna device for a wireless device, said antenna device comprising:

a segmented ground plane element including at a plurality of ground plane segments, at least one of said plurality of segments being movable relative to the other ones of said plurality of segments during operation of the wireless device;

a driven conductor element being coupled to the segmented ground plane element, said driven conductor including a first element being generally perpendicular to the segmented ground plane element and a second element being generally parallel to the segmented ground element, said second element extending away from the wireless device; and a parasitic conductor element coupled to the segmented ground element, said parasitic conductor including a first element being generally perpendicular to the segmented ground element and a second element being generally parallel to the segmented ground element, said second element extending away from the wireless device.

19. An antenna device of claim 18 wherein the second elements of the driven conductor element and parasitic conductor element are substantially parallel.

20. An antenna device of claim 18 the first elements of the driven conductor element and the parasitic conductor element are connected together.

21. An antenna device of claim 18 further comprising one or more LC trap structures for effecting a dual-band operability, said LC trap structures being coupled at a free end of either the driven conductor element or the parasitic conductor element or both.

* * * * *